US009046825B2

(12) United States Patent
Jung et al.

(10) Patent No.: US 9,046,825 B2
(45) Date of Patent: Jun. 2, 2015

(54) IMAGE FORMING APPARATUS AND METHOD OF PERFORMING SAME

(75) Inventors: Won-chul Jung, Suwon-si (KR); Do-geun Kim, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 269 days.

(21) Appl. No.: 13/478,454

(22) Filed: May 23, 2012

(65) Prior Publication Data

US 2013/0071149 A1 Mar. 21, 2013

(30) Foreign Application Priority Data

Sep. 16, 2011 (KR) ..... 10-2011-0093650

(51) Int. Cl.
*G03G 15/01* (2006.01)
*G03G 15/16* (2006.01)

(52) U.S. Cl.
CPC ..... *G03G 15/1605* (2013.01); *G03G 15/0189* (2013.01); *G03G 2215/0132* (2013.01)

(58) Field of Classification Search
CPC ..... G03G 15/0189; G03G 15/1605; G03G 15/1615; G03G 2215/0132
USPC ..... 399/121, 299, 300, 302, 313
See application file for complete search history.

(56) References Cited

U.S. PATENT DOCUMENTS

| | | | | |
|---|---|---|---|---|
| 5,469,248 | A | 11/1995 | Fujiwara et al. | |
| 6,421,521 | B2 | 7/2002 | Tanaka | |
| 6,941,102 | B2 * | 9/2005 | Sasamoto et al. | 399/299 |
| 2005/0084301 | A1 * | 4/2005 | Murakami et al. | 399/313 |
| 2005/0185991 | A1 * | 8/2005 | Iwakura et al. | 399/299 |
| 2006/0170936 | A1 * | 8/2006 | Takehara | 358/1.4 |
| 2012/0308272 | A1 * | 12/2012 | Nakaegawa | 399/302 |

* cited by examiner

*Primary Examiner* — David Gray
*Assistant Examiner* — Thomas Giampaolo, II
(74) *Attorney, Agent, or Firm* — Staas & Halsey LLP

(57) ABSTRACT

An image forming apparatus includes an intermediate transfer belt; a plurality of photosensitive bodies on which a toner image is formed, wherein the photosensitive bodies are disposed to contact the intermediate transfer belt so as to form respective transfer regions which are used to transfer the toner image to the intermediate transfer belt, wherein a first photosensitive body is disposed in the most upstream side in a proceeding direction of the intermediate transfer belt, and a transfer current density of the first transfer region is greater than a transfer current density of the remaining transfer regions.

10 Claims, 4 Drawing Sheets

IMAGE FORMING APPARATUS AND METHOD OF PERFORMING SAME

CROSS-REFERENCE TO RELATED APPLICATIONS

This application claims the benefit of Korean Patent Application No. 10-2011-0093650, filed on Sep. 16, 2011, in the Korean Intellectual Property Office, the disclosure of which is incorporated herein in its entirety by reference.

BACKGROUND OF THE INVENTION

1. Field of the Invention

The present inventive concept relates to an image forming apparatus and method of performing the same, and more particularly, to an image forming apparatus and method of image forming in which a toner image formed on a photosensitive body is passed through an intermediate transfer belt to be transferred to a recording medium.

2. Description of the Related Art

In image forming apparatuses, particularly, in an electrophotographic image forming apparatus, light that is modulated to correspond to image information is irradiated on a photosensitive body to form an electrostatic latent image on a surface of the photosensitive body, toner is supplied to the electrostatic latent image to develop the electrostatic latent image into a visible toner image, and then the visible toner image is transferred and fixed to a recording medium, thereby printing an image on the recording medium.

To print color images, toner images of different colors are formed on a plurality of photosensitive bodies, and the toner images are transferred to a recording medium directly or through an intermediate transfer belt to fix the toner images.

According to a layout of a transfer system, the transfer system may be divided into a method in which a toner image is directly transferred to a recording medium or an intermediate transfer method in which a toner image is first transferred to an intermediate transfer medium and then transferred to a recording medium. Also, the transfer system may be divided into a direct transfer method in which an intermediate transfer roller pressurizes a photosensitive body with an intermediate transfer belt between the intermediate transfer roller and the photosensitive body and an indirect transfer method in which an intermediate transfer roller pressurizes an intermediate transfer belt but does not directly pressurize a photosensitive body.

U.S. Pat. No. 6,421,521 describes a transfer system using an intermediate transfer method and a direct transfer method, and U.S. Pat. No. 5,469,248 describes a transfer system in which a toner image is directly transferred to a recording medium using an indirect transfer method.

SUMMARY OF THE INVENTION

The present inventive concept provides an image forming apparatus and an image forming method using an intermediate transfer method and an indirect transfer method.

Additional features and utilities of the present general inventive concept will be set forth in part in the description which follows and, in part, will be obvious from the description, or may be learned by practice of the general inventive concept.

Exemplary embodiments of the inventive concept provide an image forming apparatus including: an intermediate transfer belt; first and second photosensitive bodies on which a toner image is formed, wherein the first and second photosensitive bodies are disposed to contact the intermediate transfer belt so as to form first and second transfer regions which are used to transfer the toner image to the intermediate transfer belt; and first and second intermediate transfer members pressurizing the intermediate transfer belt to bring the intermediate transfer belt into contact with the first and second photosensitive bodies, the first and second intermediate transfer members not directly pressurizing the first and second photosensitive bodies, wherein the first photosensitive body is disposed in the most upstream side in a proceeding direction of the intermediate transfer belt, and a first transfer current density of the first transfer region is greater than a second transfer current density of the second transfer region.

In an exemplary embodiment, the image forming apparatus may further comprise: a power unit applying intermediate transfer bias voltages of the same amplitude to the first and second intermediate transfer members to transfer the toner image to the intermediate transfer belt, wherein a first contact length between the intermediate transfer belt and the first photosensitive body is shorter than a second contact length between the intermediate transfer belt and the second photosensitive body.

In another exemplary embodiment, a distance between the first and second intermediate transfer members and the first and second photosensitive bodies may be greater than a thickness of the intermediate transfer belt.

In another exemplary embodiment, the image forming apparatus may further comprise: first and second elastic members that respectively elastically bias the first and second intermediate transfer members toward the first and second photosensitive bodies; and first and second spacers that are respectively interposed between the first and second intermediate transfer members and the first and second photosensitive bodies to adjust the first contact length to be shorter than the second contact length.

In another exemplary embodiment, the intermediate transfer belt may circulate by being supported by a plurality of supporting rollers, and relative positions of the first and second intermediate transfer members with respect to the first and second photosensitive bodies are the same, and at least one of a diameter and a position of at least one of the plurality of supporting rollers that is closest to the first photosensitive drum satisfies a condition that the first contact length is shorter than the second contact length.

Exemplary embodiments of the inventive concept also provide an image forming apparatus including: an intermediate transfer belt; a plurality of photosensitive drums on which a toner image is formed; a plurality of intermediate transfer rollers pressurizing the intermediate transfer belt to bring the intermediate transfer belt into contact with the plurality of photosensitive drums; and a power unit applying intermediate transfer bias voltages of the same amplitude to first and second intermediate transfer members to transfer the toner image to the intermediate transfer belt, wherein the first and second intermediate transfer rollers do not directly pressurize first and second photosensitive drums, and a contact length between the intermediate transfer belt and a first photosensitive drum that is disposed most upstream in a proceeding direction of the intermediate transfer belt among the plurality of photosensitive drums is shorter than a contact length between the rest of the photosensitive drums and the intermediate transfer belt.

Exemplary embodiments of the inventive concept also provide an image forming method including: pressurizing an intermediate transfer belt to bring the intermediate transfer roller into contact with a plurality of photosensitive drums on which different colors of toner images are formed, so as to form a plurality of transfer regions, the intermediate transfer rollers not directly pressurizing the plurality of photosensitive drums; applying a plurality of intermediate transfer bias voltages to the plurality of intermediate transfer rollers from a power unit in order to transfer the toner image to the intermediate transfer belt; forming a first intermediate transfer electric field having a first transfer current density in a first transfer region which is positioned in the most upstream side in a proceeding direction of the intermediate transfer belt among the plurality of transfer regions such that regions such that the intermediate transfer belt is charged and the toner image is transferred to the intermediate transfer belt; and providing a second intermediate transfer electric field having a second transfer current density that is lower than the first transfer current density in the second transfer region besides the first transfer region among the plurality of transfer regions such that the toner image is transferred to the intermediate transfer belt.

In another exemplary embodiment, the plurality of intermediate transfer bias voltages may have the same amplitude, and a contact length between the photosensitive drums and the intermediate transfer belt in the first transfer region may be shorter than a contact length between the photosensitive drums and the intermediate transfer belt in the second transfer region.

BRIEF DESCRIPTION OF THE DRAWINGS

The above and other features and utilities of the present general inventive concept will become more apparent by describing in detail exemplary embodiments thereof with reference to the attached drawings in which.

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

As used herein, the term "and/or" includes any and all combinations of one or more of the associated listed items. Expressions such as "at least one of," when preceding a list of elements, modify the entire list of elements and do not modify the individual elements of the list.

Hereinafter, exemplary embodiments of the present inventive concept will be described with reference to the attached drawings.

Figure 1:
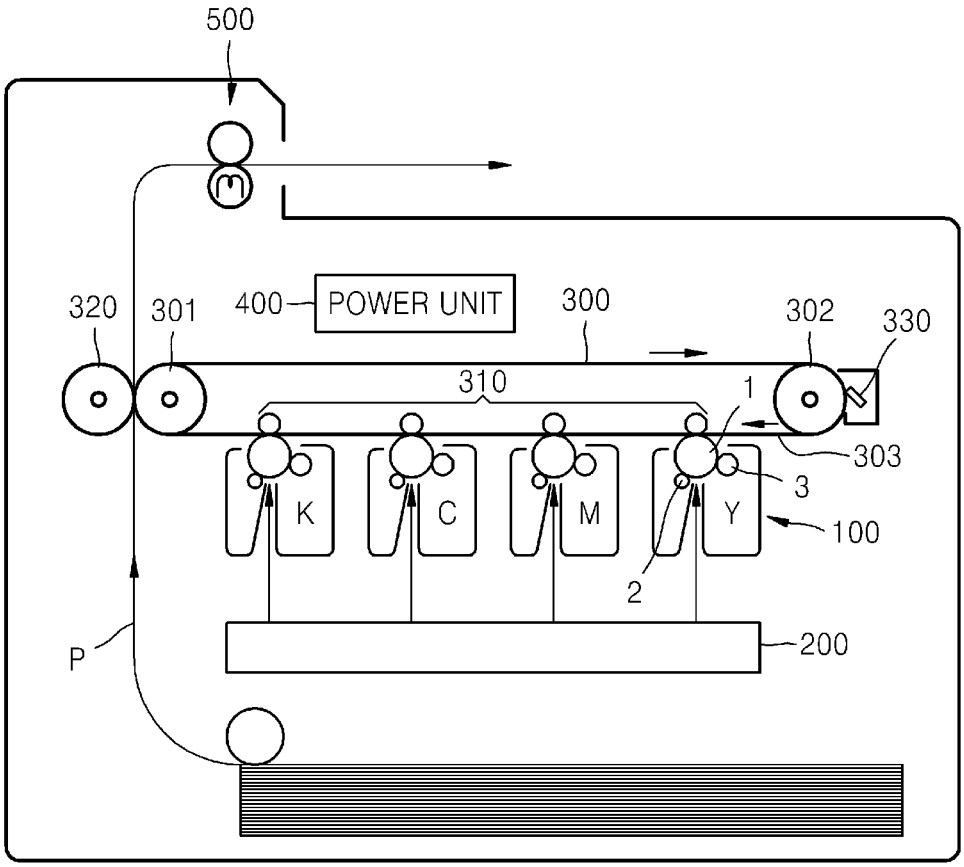
FIG. 1 is a structural diagram illustrating an image forming apparatus according to an embodiment of the present inventive concept.

FIG. 1 is a structural diagram illustrating an image forming apparatus according to an embodiment of the present inventive concept. The image forming apparatus according to the current embodiment is a color image forming apparatus that uses cyan (C), magenta (M), yellow (Y), and black (K) toners. The color image forming apparatus illustrated in FIG. 1 is referred to as a tandem-type color image forming apparatus. Hereinafter, elements used in forming C, M, Y, and K images will be respectively referred by C, M, Y, and K after their reference numerals.

Referring to FIG. 1, the image forming apparatus includes an intermediate transfer belt 300, an exposing unit 200, four photosensitive drums 1, four intermediate transfer rollers 310, a final transfer roller 320, and a fusing unit 500.

The intermediate transfer belt 300 is an intermediate transfer medium to which a toner image is temporarily transferred before being finally transferred to a recording medium P. The intermediate transfer belt 300 circulates by being supported by supporting rollers 301 and 302.

The four photosensitive drums 1 are an example of a photosensitive body on which an electrostatic latent image is formed. The photosensitive drums 1 may be a cylindrical metallic pipe with an outer circumference along which a photosensitive layer having photoconductivity is formed. The photosensitive drums 1 may contact a lower surface 303 of the intermediate transfer belt 300.

The four intermediate transfer rollers 310 are an example of an intermediate transfer member for transferring a toner image formed on the photosensitive drums 1 to the intermediate transfer belt 300. The four intermediate transfer rollers 310 are disposed to respectively face the four photosensitive drums 1 with the lower surface 303 of the intermediate transfer belt 300 therebetween. An intermediate transfer bias voltage for transferring a toner image formed on the photosensitive drums 1 to the intermediate transfer belt 300 is applied to the four intermediate transfer rollers 310.

The exposing unit 200 irradiates light that is modulated to correspond to image information to the photosensitive drums 1 to form an electrostatic latent image. As the exposing unit 200, for example, a light-emitting diode (LED) type exposing unit which selectively emits light using a plurality of LEDs arranged in a main scanning direction according to image information, may be used. Alternatively, a laser scanning unit (LSU) that deflects light irradiated from a laser diode by using a polygon mirror in a main scanning direction and irradiates the deflected light to the photosensitive drums 1 may be used as the exposing unit 200.

A developing unit 100 forms a toner image by attaching a toner contained therein to the electrostatic latent image formed on the photosensitive drums 1. The developing unit 100 may include a developing roller 3 that supplies the toner contained in the developing unit 100 to the electrostatic latent image formed on the photosensitive drums 1. A developing bias voltage to supply toner to the electrostatic latent image is applied to the developing roller 3. A charging roller 2 is an example of a charger to charge a surface of the photosensitive drums 1 to a uniform potential. A charge bias voltage is applied to the charging roller 2. Instead of the charging roller 2, a corona charger may also be used.

The final transfer roller 320 is an example of a final transferring unit to transfer the toner image on the intermediate transfer belt 300 to a recording medium P. A final transfer bias voltage to transfer the toner image on the intermediate transfer belt 300 to the recording medium P may be applied to the final transfer roller 320. Instead of the final transfer roller 320, a corona transferring unit may also be used. The fusing unit 500 fuses the toner image transferred to the recording medium P by applying heat and pressure to the toner image.

A power unit 400 supplies a charge bias voltage, a developing bias voltage, an intermediate transfer bias voltage, and a final transfer bias voltage.

A cleaning unit 330 removes toner remaining on the intermediate transfer belt 300 after the final transfer. In addition, the cleaning unit 330 erases charges remaining on the intermediate transfer belt 300.

Hereinafter, a method of forming a color image using the image forming apparatus will be briefly described.

First, according to image information of yellow color, the exposing unit 200 irradiates light to a photosensitive drum 1Y charged to a uniform potential using a charging roller 2Y to form an electrostatic latent image. When a developing bias voltage is applied to a developing roller 3Y of a developing unit 100Y, a yellow toner contained in the developing unit 100Y is attached to the electrostatic latent image formed on a surface of the photosensitive drum 1Y. The yellow toner image developed on the photosensitive drum 1Y is transferred to the intermediate transfer belt 300 by an intermediate transfer electrical field formed by an intermediate transfer bias voltage applied to an intermediate transfer roller 310Y. Also, toner images of cyan, magenta, and black colors are transferred to the intermediate transfer belt 300 in the same manner as described above so that a color toner image formed of these toner images, by being overlapped on one another, is formed on the intermediate transfer belt 300. The color toner image is transferred to the recording medium P by a final transfer bias voltage applied to the final transfer roller 320, and is then fused on the recording medium P by using the fusing unit 500.

Figure 2:
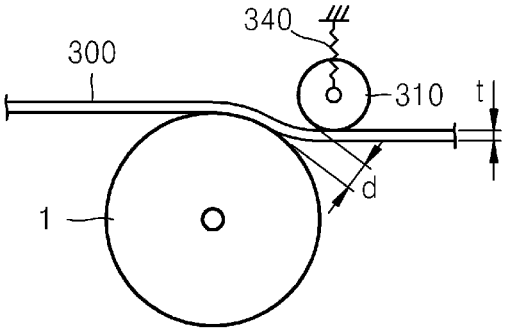
FIG. 2 is a detailed view of an arrangement of an intermediate transfer roller illustrated in FIG. 1 according to an embodiment of the present inventive concept.

FIG. 2 is a detailed view of an arrangement of the intermediate transfer roller 310 illustrated in FIG. 1, according to an embodiment of the present inventive concept. In the transfer system according to the current embodiment, an indirect transfer method in which the intermediate transfer roller 310 does not directly pressurize the photosensitive drum 1 is used. That is, while the intermediate transfer roller 310 pressurizes the intermediate transfer belt 300 to bring the intermediate transfer belt 300 into contact with the photosensitive drum 1, the intermediate transfer roller 310 does not directly pressurize the photosensitive drum 1. To this end, as illustrated in FIG. 2, a distance d between the intermediate transfer roller 310 and the photosensitive drums 1 is greater than a thickness t of the intermediate transfer belt 300. The intermediate transfer roller 310 is disposed at a position where the intermediate transfer belt 300 may contact a surface of the photosensitive drum 1 by a predetermined length. An elastic member 340, for example, a compression coil spring, elastically biases the intermediate transfer roller 310 toward the photosensitive drum 1.

Figure 3:
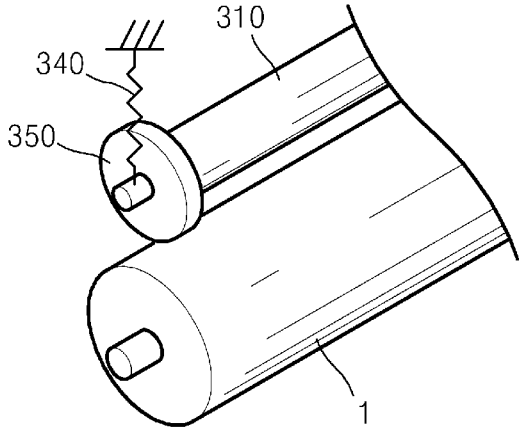
FIG. 3 is a schematic view illustrating adjustment of a distance between an intermediate transfer roller and a photosensitive drum.

FIG. 3 is a schematic view illustrating adjustment of the distance d between the intermediate transfer roller 310 and the photosensitive drum 1. A spacer 350 may be inserted at each of the two ends of the intermediate transfer roller 310. As the spacer 350 contacts a surface of the photosensitive drum 1, it maintains the distance d between the photosensitive drum 1 and the intermediate transfer roller 310. The spacer 350 may rotate while being in contact with the photosensitive drum 1.

Figure 4:
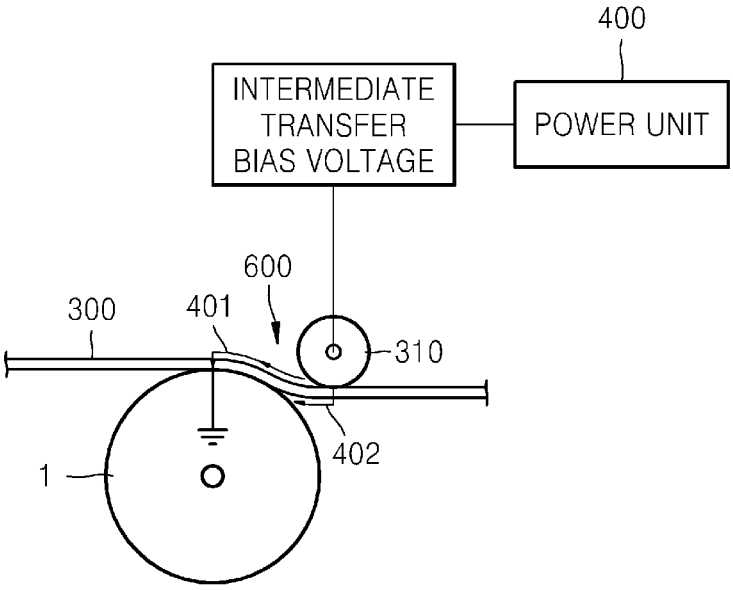
FIG. 4 is a diagram illustrating a path of an intermediate transfer current in the image forming apparatus of FIG. 1 according to an embodiment of the present inventive concept.

FIG. 4 is a diagram illustrating a path of an intermediate transfer current in the image forming apparatus of FIG. 1, according to an embodiment of the present inventive concept. The power unit 400 applies an intermediate transfer bias voltage to the intermediate transfer roller 310 to form an intermediate transfer electric field. Accordingly, the intermediate transfer current flows along a surface of the intermediate transfer belt 300, as illustrated in FIG. 4, then passes through the intermediate transfer belt 300, and reaches the photosensitive drum 1 along a path 401 and/or the intermediate transfer current first passes through the intermediate transfer belt 300, as illustrated in FIG. 4, then flows along the surface of the intermediate transfer belt 300, and reaches the photosensitive drum 1 along a path 402. The intermediate transfer current may be determined by an intermediate transfer bias voltage and the surface resistance and volume resistance of the intermediate transfer belt 300. A transfer current density of a transfer area 600 formed by contact between the intermediate transfer belt 300 and the photosensitive drum 1 may be obtained by dividing an intermediate transfer current by a contact surface area between the intermediate transfer belt 300 and the photosensitive drum 1. The transfer current density is a sufficient amount so that a toner image may be transferred from the photosensitive drum 1 to the intermediate transfer belt 300.

Figure 5:
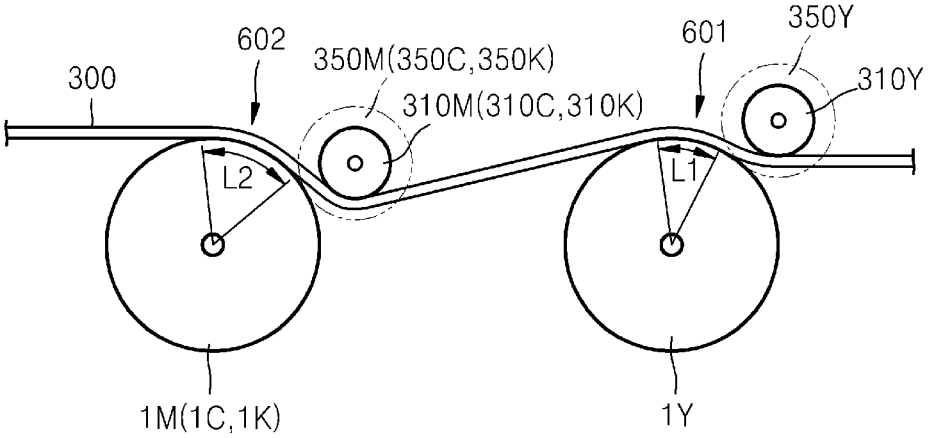
FIG. 5 is a view illustrating adjustment of a contact length between an intermediate transfer belt and first and second photosensitive drums by adjusting positions of first and second intermediate transfer rollers with respect to first and second photosensitive drums by using first and second spacers, respectively.

FIG. 5 is a view illustrating adjustment of a contact length between the intermediate transfer belt 300 and first and second photosensitive drums (1Y and 1M) by adjusting positions of first and second intermediate transfer rollers (310Y and 310M) with respect to the first and second photosensitive drums (1Y and 1M) by using first and second spacers 350Y and 350M, respectively. Similar adjustments to contact lengths between the intermediate transfer belt 300 and the third and fourth photosensitive drums 1C and 1K (see FIG. 1) by adjusting positions of respective third and fourth intermediate transfer rollers 310C and 310K (not illustrated) with respect to the third and fourth photosensitive drums 1C and 1K. These contact lengths will be referred to hereinafter as L3 and L4. An intermediate transfer process first occurs in a first transfer region 601 formed by contact between the intermediate transfer belt 300 and a first photosensitive drum 1Y that is positioned most upstream in a proceeding direction of the intermediate transfer belt 300. Next, the intermediate transfer process occurs sequentially in second, third and fourth transfer regions 602, 603 and 604 (third and fourth transfer regions 603 and 604 not illustrated) formed by contact between the intermediate transfer belt 300 and second, third and fourth photosensitive drums 1M, 1C, and 1K that are sequentially arranged downstream in the proceeding direction of the intermediate transfer belt 300. The power unit 400 applies a plurality of intermediate transfer bias voltages to a plurality of intermediate transfer rollers 310Y, 310M, 310C, and 310K to form at least first and second intermediate transfer electric fields in the first through fourth transfer regions 601 through 604, and accordingly, a color toner image is transferred to the intermediate transfer belt 300. It is to be noted that the power unit 400 may apply a first intermediate transfer electric field to the first transfer region 601 and a second intermediate transfer electric field to the second through fourth transfer regions 602 through 604, or alternatively may apply different intermediate transfer electric fields to each of the first through fourth transfer regions 601 through 604.

However, when the intermediate transfer belt 300 passes through the cleaning unit 330 after transferring a previous image to a recording medium P, charges accumulated on the surface of the intermediate transfer belt 300 are removed. Thus, in the first transfer region 601 that is disposed in the most upstream side when transferring a toner image to the intermediate transfer belt 300, the intermediate transfer belt 300 needs to be charged to a predetermined potential at the same time. That is, a transfer charge density in the first transfer region 601 should be a sufficient amount such that the intermediate transfer belt 300 will be charged to a predetermined potential and a toner image can be transferred to the intermediate transfer belt 300 at the same time. As the intermediate transfer belt 300 is already charged to a predetermined potential in the first transfer region 601, in the second and further downstream transfer regions 602, etc., only the toner image from the respective photosensitive drums has to be transferred to the intermediate transfer belt 300. Accordingly, the transfer charge density in the first transfer region 601 has to be greater than that in the second and further downstream transfer regions 602, etc. Third and fourth transfer regions 603 through 604 are not described in detail illustrated in order to provide brevity of the detailed description, since a similar description of transfer region 602 applies to these transfer regions 603 and 604.

To this end, the power unit 400 may apply to the first intermediate transfer roller 310Y an intermediate transfer bias voltage that is greater than an intermediate transfer bias voltage to second and further downstream intermediate transfer rollers 310M, 310C, and 310K.

Alternatively, the power unit 400 may apply intermediate transfer bias voltages of the same amplitude to the first intermediate transfer roller 310Y and to the second and further downstream intermediate transfer rollers 310M, 310C, and 310K, and a contact length L1 between the intermediate transfer belt 300 and the first photosensitive drum 1Y in the first transfer region 601 may be set to be shorter than a contact length L2 between the intermediate transfer belt 300 and the second photosensitive drum 1M in the second transfer region 602. It is to be noted that in this case, a contact length L1 between the intermediate transfer belt 300 and the first photosensitive drum 1Y in the first transfer region 601 may also be set to be shorter than contact lengths L3 and L4 (not illustrated) between the intermediate transfer belt 300 and the third and fourth photosensitive drum 1C and 1K (see FIG. 1) in third and fourth transfer regions 603 and 604 (not illustrated). A contact surface between the intermediate transfer belt 300 and the photosensitive drums, for example, 1Y may be expressed by the contact length L1 multiplied by a width of the intermediate transfer belt 300, and as the width of the intermediate transfer belt 300 has a fixed value, contact surface areas may vary by setting the contact lengths L1 and L2 (and contact lengths L3 and L4 which correspond with other photosensitive drums, such as photosensitive drums 1C and 1K) in the first and second transfer regions 601 and 602 (and other transfer regions such as 603 and 604) to be different. Accordingly, as the contact length L1 is set to be shorter than the contact lengths L2 through L4 so that a contact surface area in the first transfer region 601 is smaller than that of the remaining transfer regions 602 through 604, consequently, even when the same intermediate transfer bias voltage is applied, a transfer current density in the first transfer region 601 can be greater than that of the remaining transfer regions 602 through 604. Accordingly, only one intermediate transfer bias voltage needs to be applied to the power unit 400 for intermediate transfer when contract lengths of the transfer regions are adjusted, and thus the electrical configuration of the power unit 400 may be simplified, and the manufacturing costs of the power unit 400 may be reduced.

The contact lengths L1 and L2 (and L3 and L4) in the first and second transfer regions 601 and 602 (and third and fourth transfer regions 603 and 604) may be adjusted by controlling an offset amount of the first intermediate transfer roller 310Y and offset amounts of the second through fourth intermediate transfer rollers 310M, 310C, and 310K with respect to the first photosensitive drum 1Y and the second through fourth photosensitive drums 1M, 1C, and 1K. That is, a diameter of the first spacer 350Y installed on the first intermediate transfer roller 310Y and diameters of the second through fourth spacers 350M, 350C, and 350K installed on the second through fourth intermediate transfer rollers 310M, 310C, and 310K, respectively, may be set such that the contact length L1 is shorter than the contact lengths L2 through L4. According to this configuration, the first intermediate transfer roller 310Y and the second through fourth intermediate transfer rollers 310M, 310C, and 310K may be used in common, that is, may be formed to be identical, thereby reducing manufacturing costs.

Figure 6:
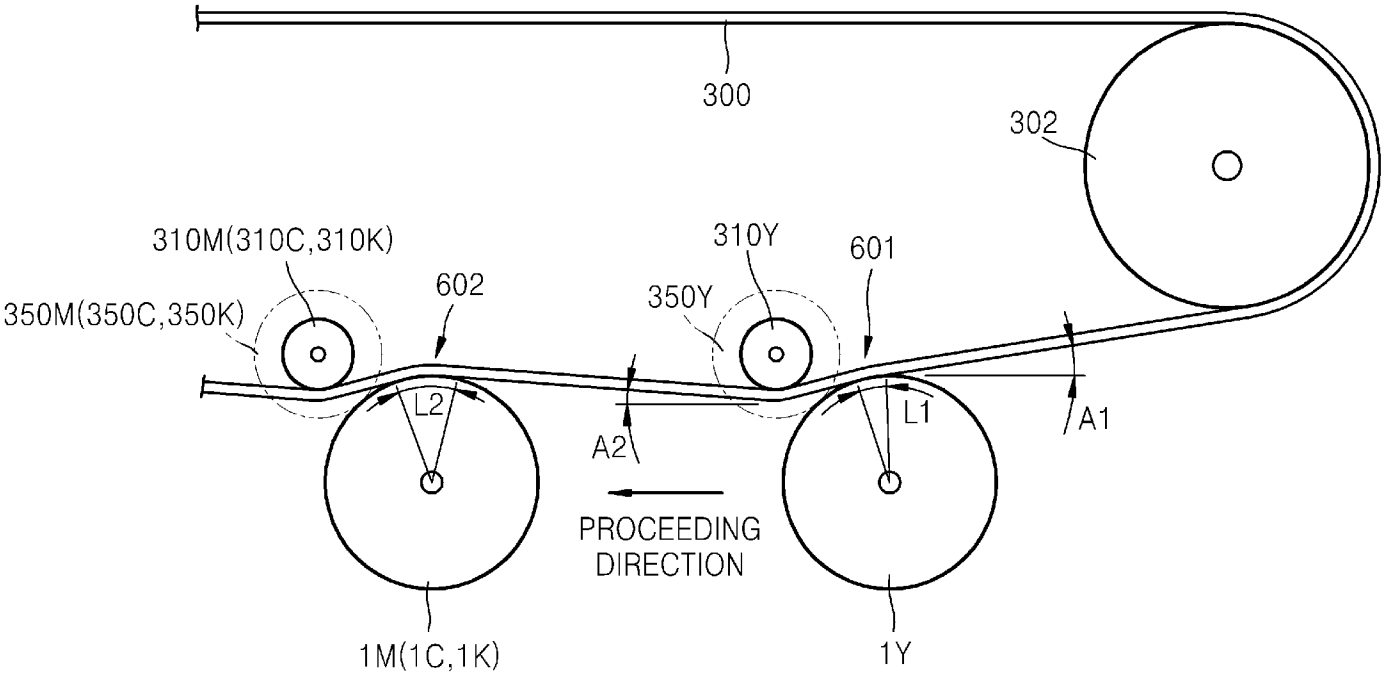
FIG. 6 is a schematic view illustrating adjustment of a contact length between an intermediate transfer belt and first and second photosensitive drums by using supporting rollers supporting an intermediate transfer belt.

Alternatively, to set the contact length L1 to be shorter than the contact length L2 and further downstream contact lengths L3 and L4 (not illustrated), a configuration as illustrated in FIG. 6 may be applied. FIG. 6 is a schematic view illustrating adjustment of contact lengths L1 and L2 between the intermediate transfer belt 300 and first and second photosensitive drums 1Y and 1M by using supporting roller 301 supporting the intermediate transfer belt 300. Similar adjustments to contact lengths L3 and L4 (not illustrated) of the further downstream photosensitive drums 1C and 1K can be provided as with the contact length L2 associated with the photosensitive drum 1M, as suggested by the brackets in FIG. 6. Here, a relative position of the first intermediate transfer roller 310Y with respect to the first photosensitive drum 1Y and a relative position of the second and further downstream intermediate transfer rollers 310M, 310C, and 310K with respect to the second and further downstream photosensitive drums 1M, 1C, and 1K, respectively, are set to be the same. Then, among the supporting rollers 301 and 302 supporting the intermediate transfer belt 300, a position and/or a diameter of the supporting roller 302 positioned upstream of the first photosensitive drum 1Y may be set to satisfy the condition that the contact length L1 is shorter than the contact length L2 (and contact lengths L3 and L4).

For example, the first intermediate transfer roller 310Y and the second and further downstream intermediate transfer rollers 310M, 310C, and 310K are arranged downstream in a proceeding direction of the intermediate transfer belt 300 with respect to the first photosensitive drum 1Y and the second and further downstream photosensitive drums 1M, 1C, and 1K, respectively. Referring to FIG. 6, according to this exemplary embodiment, an exit angle at which the intermediate transfer belt 300 passes the first photosensitive drum 1Y and the second and further downstream photosensitive drums 1M, 1C, and 1K is the same, and an incident angle A2 at which the intermediate transfer belt 300 is incident from the first intermediate transfer roller 310Y to the second photosensitive drum 1M is determined by the position of the first intermediate transfer roller 310Y. Accordingly, a diameter and/or position of the supporting roller 302 may be determined such that the incident angle A1 of the intermediate transfer belt 300 being incident from the supporting roller 302 to the first photosensitive drum 1Y satisfies the condition L1<L2. According to this configuration, the diameters of the first spacer 350Y and the second and further downstream spacers 350M, 350C, and 350K may be set the same, and thus the number of commonly manufactured components may be further increased, thus reducing the time and costs of manufacturing components.

As described above, by setting the transfer current density in the first transfer region 601 that is arranged most upstream to be greater than the transfer current density in the second transfer region 602 (and further downstream transfer regions (not illustrated)), a current used to charge the intermediate transfer belt 300 in a first intermediate transfer operation may be compensated for, thereby improving the quality of the intermediate transfer. By setting a transfer current density by adjusting a contact length between the photosensitive drums 1 and the intermediate transfer belt 310, the structure of the power unit 400 may be simplified. By setting a transfer current density by adjusting an offset amount of the intermediate transfer rollers 310 with respect to the photosensitive drums 1 or adjusting the position or diameter of the supporting roller 302 supporting the intermediate transfer belt 300, components may be used in common, thereby reducing manufacturing time and costs.

According to the current embodiment of the present inventive concept, respective contact lengths L2, L3 and L4 between the intermediate transfer belt 300 and the second photosensitive drums 1M, 1C, and 1K, respectively, may be the same or different (L3 being the contact length between the intermediate transfer belt 300 and the third photosensitive drum 1C, and L4 being the contact length between the intermediate transfer belt 300 and the fourth photosensitive drum 1K). The respective contact lengths L2, L3 and L4 between the intermediate transfer belt 300 and the second, third and fourth photosensitive drums 1M, 1C, and 1K, respectively, may be set to obtain an optimum intermediate transfer efficiency in a range in which the contact lengths L2, L3 and L4 are longer than the contact length L1 between the intermediate transfer belt 300 and the first photosensitive drum 1Y.

While the present general inventive concept has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. An image forming apparatus, comprising:

an intermediate transfer belt;

first and second photosensitive bodies on which a toner image is formed, the first photosensitive body being disposed in the most upstream side in a proceeding direction of the intermediate transfer belt, the first and second photosensitive bodies being disposed to contact the intermediate transfer belt to form first and second transfer regions which are used to transfer the toner image to the intermediate transfer belt, and a first transfer current density of the first transfer region being greater than a second transfer current density of the second transfer region;

first and second intermediate transfer members pressurizing the intermediate transfer belt to bring the intermediate transfer belt into contact with the first and second photosensitive bodies, respectively, the first and second intermediate transfer members not directly pressurizing the first and second photosensitive bodies;

a first spacer concentric with the first intermediate transfer member and having a first diameter to contact the first photosensitive drum to separate the first intermediate transfer member from the first photosensitive drum at a first distance; and a second spacer concentric with the second intermediate transfer member and having a second diameter different from the first diameter to contact the second photosensitive drum to separate the second intermediate transfer member from the second photosensitive drum at a second distance different from the first distance.

2. The image forming apparatus of claim 1, further comprising:

a power unit applying intermediate transfer bias voltages of the same amplitude to the first and second intermediate transfer members to transfer the toner image to the intermediate transfer belt, wherein a first contact length between the intermediate transfer belt and the first photosensitive body is shorter than a second contact length between the intermediate transfer belt and the second photosensitive body.

3. The image forming apparatus of claim 2, wherein both the first distance between the first intermediate transfer member and the first photosensitive body and the second distance between the second intermediate transfer member and the second photosensitive body is greater than a thickness of the intermediate transfer belt.

4. The image forming apparatus of claim 3, further comprising:

first and second elastic members that respectively elastically bias the first and second intermediate transfer members toward the first and second photosensitive bodies.

5. The image forming apparatus of claim 3, wherein the intermediate transfer belt circulates by being supported by a plurality of supporting rollers, and relative positions of the first and second intermediate transfer members with respect to the first and second photosensitive bodies are the same, and at least one of a diameter and a position of at least one of the plurality of supporting rollers that is closest to the first photosensitive drum satisfies a condition that the first contact length is shorter than the second contact length.

6. The image forming apparatus of claim 1, wherein the second diameter is larger than the first diameter.

7. The image forming apparatus of claim 1, wherein the first distance between the first intermediate transfer member and the first photosensitive drum is smaller than the second distance between the second intermediate transfer member and the second photosensitive drum.

8. An image forming apparatus, comprising:

an intermediate transfer belt;

a plurality of photosensitive drums on which a toner image is formed;

a plurality of intermediate transfer rollers to pressurize the intermediate transfer belt to bring the intermediate transfer belt into contact with a respective one of the plurality of photosensitive drums; and a power unit to apply intermediate transfer bias voltages of the same amplitude to the intermediate transfer rollers to transfer the toner image to the intermediate transfer belt, wherein the intermediate transfer rollers do not directly pressurize the respective ones of the photosensitive drums, and a first contact length between the intermediate transfer belt and a first one of the photosensitive drums that is disposed most upstream in a proceeding direction of the intermediate transfer belt among the plurality of photosensitive drums is shorter than a second contact length between the rest of the photosensitive drums and the intermediate transfer belt, such that a first distance between a first one of the plurality of intermediate transfer rollers and the first one of the photosensitive drums is the same as a second distance between a second one of the plurality of intermediate transfer rollers and the second one of the photosensitive drums.

9. The image forming apparatus of claim 8 further comprising:

first and second supporting rollers configured to support the intermediate transfer belt and cause it to move in the downstream direction.

10. The image forming apparatus of claim 9, wherein at least one of a position and a size of at least one of the first and second supporting rollers is adjusted to establish the first and second contact lengths.

* * * * *